United States Patent [19]

Corby

[11] Patent Number: 4,654,745

[45] Date of Patent: Mar. 31, 1987

[54] ELECTRONIC ACCESS CONTROL SYSTEM FOR USE WITH CONVENTIONAL SWITCH PLATES AND BOXES

[75] Inventor: Timothy W. Corby, Allentown, Pa.

[73] Assignee: Corby Industries, Inc., Allentown, Pa.

[21] Appl. No.: 685,294

[22] Filed: Dec. 24, 1984

[51] Int. Cl.[4] ..... H01H 47/22; E05B 45/06

[52] U.S. Cl. ..... 361/171; 310/543

[58] Field of Search ..... 361/171, 400; 340/543

[56] References Cited

U.S. PATENT DOCUMENTS

| | | | |
|---|---|---|---|
| 3,717,866 | 2/1973 | Ehrlich | 340/147 |
| 3,772,574 | 11/1973 | Hughes | 317/134 |
| 3,828,340 | 8/1974 | Bauer, Jr. | 340/276 |
| 3,885,408 | 5/1975 | Clark, Jr. | 70/278 |
| 3,940,738 | 2/1976 | Teeters | 340/147 |
| 3,958,231 | 5/1976 | Hoffman | 340/274 |
| 4,114,147 | 9/1978 | Hile | 340/528 |
| 4,258,346 | 3/1981 | Williams | 340/543 X |
| 4,258,358 | 3/1981 | Lee et al. | 361/171 X |
| 4,408,251 | 10/1983 | Kaplan | 340/543 X |

OTHER PUBLICATIONS

Technical Publication LS7228/LS7229 by LSI Computer Systems Inc. dated Feb. 1983 Entitled Address Decorder/Two Pushbutton Digital Lock.

*Primary Examiner*—Michael L. Gelliner

*Attorney, Agent, or Firm*—Charles A. Wilkinson

[57] ABSTRACT

An electronic access control system is provided including a two dual button self contained sequential code device that can be accommodated in a standard wall box and used in conjunction with a standard toggle switch type wall plate. The device is particularly useful as a disarming mechanism for security systems because of its inconspicuousness. The device comprises an electronic voltage regulator, input circuit network, timing circuit, coding circuit, logic network and output circuit. A condition indicating circuit and tamper circuit are also provided. The logic network preferably comprises an integrated circuit with 9 code inputs and a debouncing circuit arrangement is incorporated in the input network circuit.

20 Claims, 11 Drawing Figures

ELECTRONIC ACCESS CONTROL SYSTEM FOR USE WITH CONVENTIONAL SWITCH PLATES AND BOXES

BACKGROUND OF THE INVENTION

1. Field of the Invention

The present invention relates generally to electronic access control systems actuated by coded input and more particularly to a code type electronic access control system adapted for mounting in conventional wall switch boxes provided with standard toggle type switch plate closures.

2. Description of the Prior Art

The use and construction of electronic combination locks for securing various closure means such as residence and business premise doors, garage and vehicle doors and for the operation of other access control and securing means are well known in the art. Such code type acces control devices usually employ a plurality of push-button input switches. These switches when operated in a predetermined code sequence or combination may activate circuits to arm or disarm a security system. Alternatively, such devices may operate a solenoid or similar device to move or release a bolt or other means to lock or unlock a security device or closure. Alternatively, an electronic combination lock may be operated or triggered by actuation of a single push-button switch in a timed predetermined sequence.

The following patents are illustrative of prior art technology in this general area.

U.S. Pat. No. 3,633,167 to R. A. Hedin (1972)
U.S. Pat. No. 3,772,574 to D. C. Hughes (1973)
U.S. Pat. No. 4,197,524 to R. J. Salem (1980)
U.S. Pat. No. 4,408,251 to I. M. Kaplan (1983)
U.S. Pat. No. 4,425,597 to W. E. Schramm (1984)
U.S. Pat. No. 4,455,588 to H. Mochida (1984)

U.S. Pat. No. 3,633,167 to R. A. Hedin discloses a push-button security control system using solid-state components for generation of a preselected combination of coded signals upon operation of push button means and includes both a timing circuit to assure the correct code signal is generated within a predetermined interval and means to allow ready alteration of the preselected code.

U.S. Pat. No. 3,772,574 to Hughes discloses an electronic combination lock that uses a plurality of logic functions requiring the input of a predetermined number of pulses to a counter means for opening a lock.

U.S. Pat. No. 4,197,524 to Salem discloses an electronic combination lock activated by a series of sequential taps upon a surface such as a wall in a predetermined interval pattern. The apparatus compares the pattern of taps received with a predetermined pattern and operates a lock only if the two patterns conform.

U.S. Pat. No. 4,408,251 to Kaplan discloses a push-button type security system in which either a plurality of push buttons are operated in a predetermined sequence or a single push button is operated in a coded sequence. The coded signals are directed over a minimum of conductors to a security system within a secure area such as within a garage at a location removed from the access door.

U.S. Pat. No. 4,425,597 to Schramm discloses an electronic combination lock designed for use in automobiles and operated by sequential pulses directed from two activator means such as push buttons or the like.

U.S. Pat. No. 4,445,588 to Mochida et al discloses an electronic push-button lock operated with a single push button which may be activated in a sequential code pattern in the form of a tune or melody.

Although the above and other devices have been used and in some cases have achieved widespread use, they have been subjected to several serious drawbacks and disadvantages.

On of such disadvantages is the necessity of providing special mounting and protective means for such electronic locking systems. A further disadvantage is that most combination type electronic locks use a plurality of push buttons for encoding and consequently require a relatively large mounting and containment means. These disadvantages not only increase the cost of such electronic systems, but make them conspicuous so that some of the advantages of the coded lock are lost.

Multiple push-button electronic combination locks are also subject to decipherment of the combination by close observation and by so-called "dusting". In "dusting" the push buttons are dusted by unauthorized persons with a chemical compound prior to operation of the push-button panel in the correct combination by an authorized person desiring to gain access to a secure area. The push buttons may subsequently be examined by the unauthorized person, i.e. the duster, and by a simple chemical analysis the particular buttons which have been activated are easily identified. While the sequence of operation of such buttons is not revealed by dusting, identification of the activated buttons serves to substantially reduce the number of possible operational combinations to a number small enough to enable solution and detection of the correct combination within a relatively short period, thus seriously compromising the security of the locking system.

While various types of combination locks have, furthermore, been devised with only one or two sequentially operated code buttons, as illustrated by the Kaplan and Schramm patents mentioned above, which avoid the difficulty of "dusting", such sequential time coded systems have not provided a complete solution of the above encountered problems and have been subject to other disadvantages.

Further disadvantages of many such prior art devices is the necessity of drilling special holes or openings in conspicuous places to accommodate the push-button switch mechanism. Prior locking systems, furthermore, have not been easily mounted in locations where space is at a premium such as, for example, locations on door jambs and the like between large glass or other panels. Such environments may be found, for example, on glass store fronts and the like where only relatively narrow jambs and moldings are positioned between large glass expanses.

As pointed out above prior devices have tended to be conspicuous so far as their security functions are concerned, thus drawing the attention and interest of unauthorized persons. For example, the display of a multi-push-button panel at or near a closure means such as a door is more than likely to arouse the interest of unauthorized persons in such closure and the reaso for the use of extraordinary protective measures to maintain the security of such closure. The security system itself may thus tend to increase attempts to breach security. The conspicuousness of a code panel is of particular importance when such panel is used as a disarming device as will presently be explained.

While the fewer code buttons that are used, the smaller the overall size of the push-button panel, and the less conspicuous it will be, even those panels making use of only two sequentially operated code buttons have required specialized mounting means and have tended to be fairly conspicuous. Furthermore, arrangements such as disclosed in U.S. Pat. No. 4,197,524, which have required no switch panel at all, have been expensive to implement and are not usable in all locations since the surface to be tapped must be of such character as to readily transmit distinct shock impulses. Furthermore, a fairly vigorous tap is necessary to activate the code system, else such system will be too easily activated and will be interfered with by noise and other disturbances in the environment. Moreover, the imposition of fairly heavy tapping on the surface is subject to both visual and aural observation or detection which may result in inadvertent transfer of the code to unauthorized persons. The surface must also, of course, tend to damp continuing vibrations rather than be subject to large continuing secondary and harmonic vibrations which could interfere with detection of the primary code impulses.

There has consequently been a need for a relatively simple, compact and self contained code type locking-/unlocking system that may be easily mounted in either existing mounting receptacles such as light switch receptacles and the like or alternatively may be easily contained and mounted in conventional light type switch receptacles without the use of special or auxiliary mounting means.

There has been a particular need for a simple, economical and inconspicuous access control device for arming and disarming various types of security systems in secure areas in households, offices and government installations. In such environments a master security control panel is usually provided in a secure location within the secured premises and is customarily locked against tampering. The security system may typically include audible or visual alarm means activated by detection of the presence of an intruder or unauthorized person within such premises. Such alarm may be activated in any known fashion, for example, by heat or infrared detection of the presence of a living body, or by the detection of sound, movement, interruption of light beams and by the use of other physical principles. Upon the detection of signals indicating the apparent presence of an intruder, an alarm circuit is activated by the security system and an alarm set off either audible on the premises, or visual or audible at some other location such as a security station manned by security personnel or at a central police station or the like.

Typically there is a predetermined time delay from first detection of the presence of an apparent intruder to the instigation of an alarm in order to provide time for authorized persons to identify themselves to the security system or to otherwise deactivate the system. Typically in a residence or business, for example, there will be a 40 to 50 second time delay for a person entering the premises to activate a means to disarm the alarm system. For example, in a residence, switch means will be located inside but adjacent to the entrance, that is within an alarm zone. Such switch means is activated by the residents to turn on, or arm, the alarm system before leaving and is again activated by the residents to turn off, or disarm, the system upon reentering the premises. The amount of time provided to disarm the system is dependent essentially upon the degree of difficulty of the actual disarming operation, which operation can be divided into two periods. The first of such periods is the time taken to locate the disarming means and the second of such periods is the time required by both an authorized person and an unauthorized person to correctly actuate the disarming mechanism or means. If it is both difficult to find the disarming means and difficult to activate it, a significantly greater time can be allowed for disarming than if only one such difficulty is present. A longer time period is advantageous for activation by authorized persons, since such longer period diminishes the possibility of mistakes resulting in accidental activation of the alarm. A shorter period on the other hand increases the security of the system. Thus increasing difficulty in finding and disarming the securing disarming means significantly increases the overall security of the system. It is advantageous, therefore, if a disarming device is difficult of access for unauthorized persons, but easy of access for authorized persons, i.e. because such persons know where it is. This will inherently provide the authorized person with additional time to activate the disarming device in the correct manner, thus diminishing possible errors. It is also advantageous if a finite time is available to input a correct code sequence so an unauthorized person is under a further time constraint to correctly operate the code device.

It will be seen, therefore, that a security system may be secure in proportion to several interrelated factors (a) the time required for operation must be limited to interfere with decoding or tampering by unauthorized persons, but not so limited as to deny authorized persons a reasonable time to operate the system, (b) the difficulty of operation must be compatible with the time available, the sophistication and patience of the authorized persons who will be using the system and the cost benefits of the security measures to be taken. It is advantageous usually to increase the difficulty of identifying the disarming means in order to allow as much time as possible, consistent with security, to correctly activate such disarming means.

Unfortunately, in former alarm systems it has seldom been possible to maintain the basic factors of security for disarming systems at their maximum effectiveness. Thus, if an uncomplicated disarming mechanism is used, it may be made more difficult to identify or locate, while keeping the activation time low. On the other hand, if a more sophisticated or complicated security activation arrangement is used, it is usually more difficult to conceal except by providing false concealment such as hidden closure means and the like, for example, a false panel behind which a key or multicontact code panel is concealed.

Unfortunately, the provision of such arrangements as hidden panels and the like to increase the time likely to be necessary for an intruder to find or identify the disarming means also requires provision of more delay time for authorized person to reach and deactivate the disarming means.

There has, therefore, been a need for a code type security control or access control device which is particularly applicable to use for disarming a security system which optimizes interrelation of the various factors contributing to effective security of such systems.

There also has been a need for a code type locking-/unlocking system which after mounting is inconspicuous yet easily operated and at the same time secure.

There has further been a need for a locking/unlocking system which is economical and simple to install and can be installed in standard wall type receptacles with a minimum of specialized tools or mounting means.

SUMMARY OF THE INVENTION

The above and other problems and requirements have now been obviated by the present invention which provides a self-contained electronic access control device or locking/unlocking unit which may be mounted in standard wall panel light switch boxes and the like which accept standard toggle switch plates. More particularly, the present invention provides an electronic locking system comprised of an integrated circuit and auxiliary solid state apparatus arranged on a circuit board dimensioned to fit within a standard light type switch and to be covered with a standard toggle switch plate. The electronic system of the invention provides two push buttons adapted to protrude in operating position through one of the orifices of a single toggle switch opening of a standard toggle switch face plate, preferably together with one or two operation indicating optical light emitting diodes LEDS.

The device of the invention is particularly suitable for use as the disarming means in a security system. In such use the three main factors of security, i.e.

(a) difficulty in finding or identifying the disarming means,
(b) difficulty in activating the disarming means, and
(c) time allowed for disarming, can be optimized so that general security is enhanced and other factors optimized also.

In accordance with the invention, the difficulty of finding the disarming mechanism is enhanced by causing the disarming mechanism to blend in with its surroundings by the use of standard light switch plates in which the code buttons are inconspicuous, by using a sequential code which requires only two code contacting means (push button contacts) which push buttons can be very quickly activated, but which code is difficult to duplicate or decipher, and by maintaining a short prealarm delay period so that an unauthorized person is provided with as little time as possible to find and decipher the disarming system in order to breach the securing system. In addition, the disarming system is attractive and economical for use in households and businesses in particular, since the major exposed portion is minimal in its physical extent and is covered or obscured by a standard electrical switch plate. Preferably the code system will also incorporate code detection means coupled with a time delay means which allows a finite period to input the correct code or portions of the code and resets the code sequence so that the entire code must be reentered within the finite time delay if a mistake is made.

The two button access control device of the invention may also readily be used to limit or control access to secure areas by controlling an alarm system and/or electrically operate doors and gates. The electronic device of the invention uses an integrated circuit (IC) and various electronic components, i.e. resistors, capacitors, diodes, transistors and the like mounted on a printed circuit board (PCB) as an operating subassembly adapted for mounting on a conventional metal or plastic National Electrical Manufacturers Association (N.E.M.A.) standard electrical switch, wall plate. The two push buttons of the device are positioned and dimensioned so that they extend through the opening in the wall switch plate normally containing or designed for receipt of a toggle switch for operating a light circuit. The toggle switch plate may be of the single switch, double switch or multiple switch type, but the operational buttons of the device of the invention extend through only one opening leaving any other opening free for reception of other operating control means or devices such as, for example, additional security circuits or conventional light or other circuits. The access control device of the invention is a self contained electronic code switch device which when operated will complete an electrical circuit and cause a current to flow to arm or disarm or to operate a remote electrical actuation device such as a lock, alarm system or the like. Preferably several light emitting diodes (LED's ) will be mounted together with the push buttons in the switch plate opening and may be used to indicate or monitor the condition or actuation of the security device circuits. When mounted in a switch box and shielded by its standard switch plate, the device of the invention is both inconspicuous and attractive and may blend easily into the decor of its surroundings, while at the same time providing a convenient and secure access control device. Various means may, of course, be used to prevent removal of the switch plate by unauthorized persons to gain access to and tamper with the device of the invention.

The security device of the invention includes mounted upon a printed circuit board (a) a pair of substantially adjacent pushbutton contacts dimensioned for passage or extension through the orifice of a conventional toggle switch plate when the printed circuit board is mounted adjacent said switch plate, and (b) a series of interconnected circuit components mounted upon said printed circuit board including (i) a voltage regulation circuit for regulating power supplied to the electronic code system, (ii) a timing circuit for timing input of coded signals to the elctronic system, (iii) an input circuit connected through the push-button contacts for input to the system of sequentially coded signals, (iv) a logic circuit preferably in the form of an integrated circuit (IC) for monitoring and detection of sequentially coded signals input into the system (the IC comprises essentially a shift register plus conditioning circuits), (v) a coding section which may be used to predetermine or preset the code sequence which the logic circuit monitors, (vi) a tamper detection circuit for monitoring and detection of attempted access to the circuit components of the security device, (vii) a status indication circuit for visual indication of the status or condition of the security system or the electronic components thereof, and (viii) an output circuit for providing actuation current to actuating circuits for a security locking or alarm device.

BRIEF DESCRIPTION OF THE DRAWINGS

FIG. 4(*a*) is an isometric view of the push button contacts of FIG. 4 disassembled to show its construction.

DESCRIPTION OF THE PREFERRED EMBODIMENTS

The present invention provides an electronic security system which is particularly useful as a disarming means for a security alarm system, but may also be used for other security purposes such as direct or indirect locking or unlocking of doors such as garage doors and the like.

The security system is designed to be used with a standard toggle switch plate with its activation buttons extending through one of the toggle switch holes of the switch plate. Where applicable, the switch plate and the printed circuit board upon which the electronic components are mounted may then be mounted in a standard wall box, or, where the particular local electrical code allows, since the operating voltage is low, the access control device circuit may be mounted directly in an opening in a wall without a wall box. The arrangement is both economical and attractive because of the use of a standard switch plate, the attractiveness resulting largely from the uniformity with other electrical equipment in the home or residence. In addition, as explained earlier, the device substantially enhances security, particularly in arming and disarming circuits for security alarm systems, since the resulting disarming means is inconspicuous and thus not immediately evident to an intruder, yet provides a very secure code input system using two code input buttons which may be sequentially operated in a predetermined coded security signal. The inconspicuousness and two contact coded input, which is quickly and conveniently operated, make it possible to operate with a short alarm delay interval, thus optimizing the three important factors in security systems.

Figure 1:
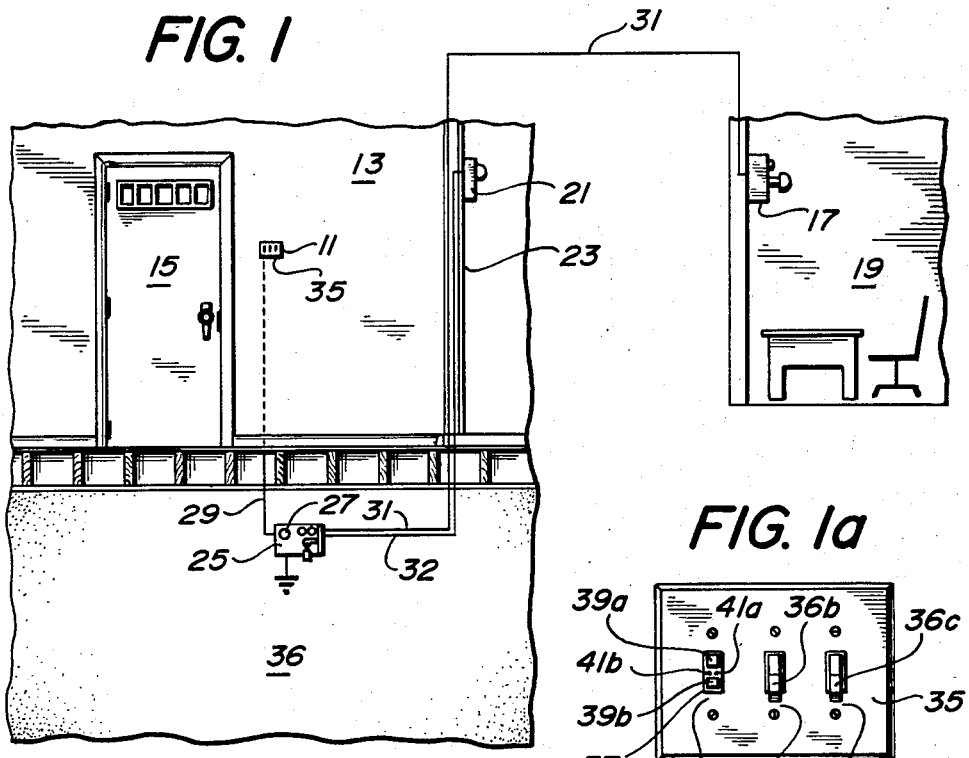
FIG. 1 is a diagrammatic overall illustration of an access control device in accordance with the invention arranged to arm or disarm a security system.
Figure 1A:
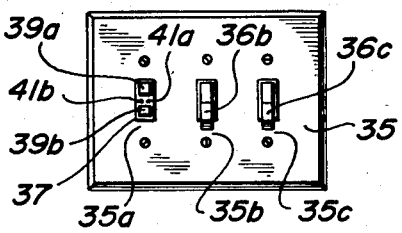
FIGS. 3 and 1*a* and is an enlarged elevational view of the front of the security device of the invention showing the activating code buttons extending through an opening in a toggle switch plate.

The security system of the invention is described hereinafter in connection with the annexed drawings in which FIG. 1 shows diagrammatically an access control device 11 mounted as is typical for light switch combinations on a wall 13 adjacent the inside of a door 15 in a residence which is protected by a remote alarm 17 which may be at a normal security station 19 in a remote location such as in a police station or commercial detective agency. An audible alarm 21 may also be situated on an outside wall 23 of the residence. Both alarms 17 and 21 are controlled from a master control or alarm panel 25 positioned in a location remote from the door 15 in the secured area such as shown in the basement 36 of the residence. The master control 25 panel has a relay 27 mounted thereupon which is in a circuit 29 between the access control device 11 and the control panel 25. The control panel 25 is connected with and controls the alarm 17 and 21 via circuits 31 and 32. The switch 35 is a standard light switch plate or toggle switch plate designed to appear to be a standard light switch plate. In the example shown the switch plate 35, as shown in the blown up of such switch plate designated FIG. 1(*a*) has three toggle switch orifices 35*a*, 35*b* and 35*c* therein. Two of these orifices accommodate conventional toggle type light switches 36*b* and 36*c* protruding therefrom which may typically be in circuit with and operate a light for the area inside the door 15 and another more remote light, neither of which is shown. The third toggle switch orifice instead of containing a conventional toggle switch contains a push-button switch 37 comprised of two push buttons 39*a* and 39*b* arranged one over the other for convenient and speedy operation by two adjacent fingers of the human hand. Preferably the two push buttons, which are dimensioned to precisely fit within the toggle switch orifice at both sides plus the top and bottom, are preferably separated by two light emitting diodes or LED's 41*a* and 41*b* arranged side by side between the buttons 39*a* and 39*b*. It will be understood that the LED's , which are useful for visually indicating the condition of the security system to the operator, could be positioned other than between the two push buttons, for instance at the top of or the bottom of the toggle switch orifice, either above or below both push buttons, or alternatively the LED's can be omitted entirely since they are merely a convenience in monitoring the condition of the security system. From a aesthetic standpoint it is most desirable to have the two LED's ocated between the two push buttons, as this provides a more balanced and pleasing appearance.

The two push buttons 39*a* and 39*b* and the LED's 41*a* and 41*b* are inconspicuous because of their placement or framing within the openings in an ordinary toggle switch plate and their association with ordinary toggle switches. The security system can thus serve effectively as an arming and disarming means for the master control panel. Furthermore, the security device is both attractive and economical. The device and its function can be rendered even more inconspicuous and less evident to unauthorized persons if it is mounted as a portion of a light switch and plate associated not with the switch immediately inside the door 15, but at an adjacent wall switch such as, for example, a switch controlling light in an adjacent room such as, for example, an adjacent living room or the like. Under such conditions the three main considerations of a disarming control will be fulfilled i.e. the disarming circuit or switch is inconspicuous so that a significant time must be spent by an unauthorized person in locating it, the security disarming device is difficult to operate in that the correct code sequence must be known or deciphered in order to operate it, and input of the proper code must also be accomplished within a predetermined time period and without mistakes in order to be successful. In other words the time for identification of the disarming device is maximized for unauthorized persons, thus minimizing the time for successful operation by such persons; the opposite relationship being true, however, for authorized persons. In addition to these principal and most important characteristcs, the security system of the invention is also simple and convenient to operate by authorized persons familiar with its preset code. Furthermore, the security device is attractive and easily adaptable to almost any household decor by reason of its inconspicuous nature.

Figure 2:
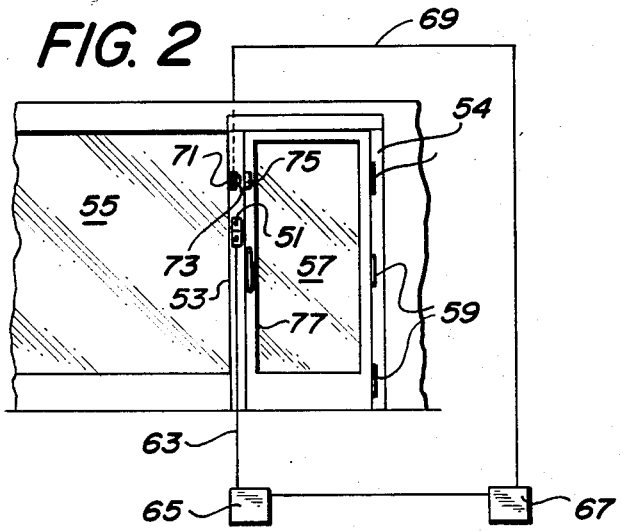
FIG. 2 is a diagrammatic view of the security device of the invention arranged to activate a primary security system in the form of a locking member.

FIG. 2 is a diagrammatic representation of the security device of the invention used to operate a lock on, for example, a door. In this example, 51 is a narrow switch plate designed for, or simulating design for, a toggle type switch. The plate 51 has standard dimensions fitting it for use on a typical narrow metal door post 53 located on a glass store front having transparent windows 55 and a transparent door 57 swingably mounted upon a second doorpost 54 by hinges 59. By entering a suitable code sequence into the security device of the invention by means of code buttons 61*a* and 61*b*, the security device is activated to send a signal over line 63 to a relay 65 shown in dotted outline, which when it closes, allows current to flow from a power source 67 via conductor 69 to a solenoid 71 which operates a bolt mechanism 73 on the doorpost 53 which bolt interlocks with a catch 75 on the frame 77 of the transparent door 57. Because of the small size of the security system of the invention, it can be easily accommodated upon the usual narrow doorpost on glass storefronts whereas prior code button type security systems have either been too large to mount at all on such door posts or only a portion of the security system could be so accommodated.

Figure 3:
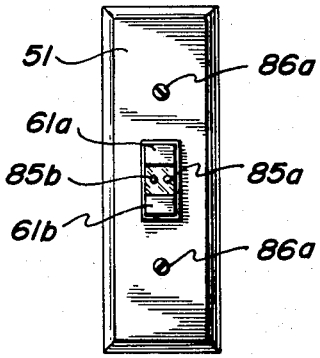

FIG. 3 is an enlarged elevational view of the face of the access control device of the invention shown in FIG. 2 showing the activating code buttons 61*a* and 61*b* in place within the toggle switch orifice 83 of a standard narrow electrical wall switch plate 51. A pair of light emitting diodes (LED's ) 85*a* and 85*b* are desirably mounted in the same switch plate orifice 83. It will be understood that the LED s could also be positioned at the top or bottom of the two push buttons 61*a* and 61*b*, or in another position entirely. However, it is desirable from an aesthetic viewpoint to place the LED's between the two push butttons as this provides an attractive balanced appearance. The usual two fastening openings 86*a* and 86*b* are shown above and below the push buttons 61*a* and 61*b*. The switch plate 51 is secured to the electronic portions of the access control device by screw fastenings 86 in the fastening openings 86*a* and 86*b*.

Figures 4, 4A:
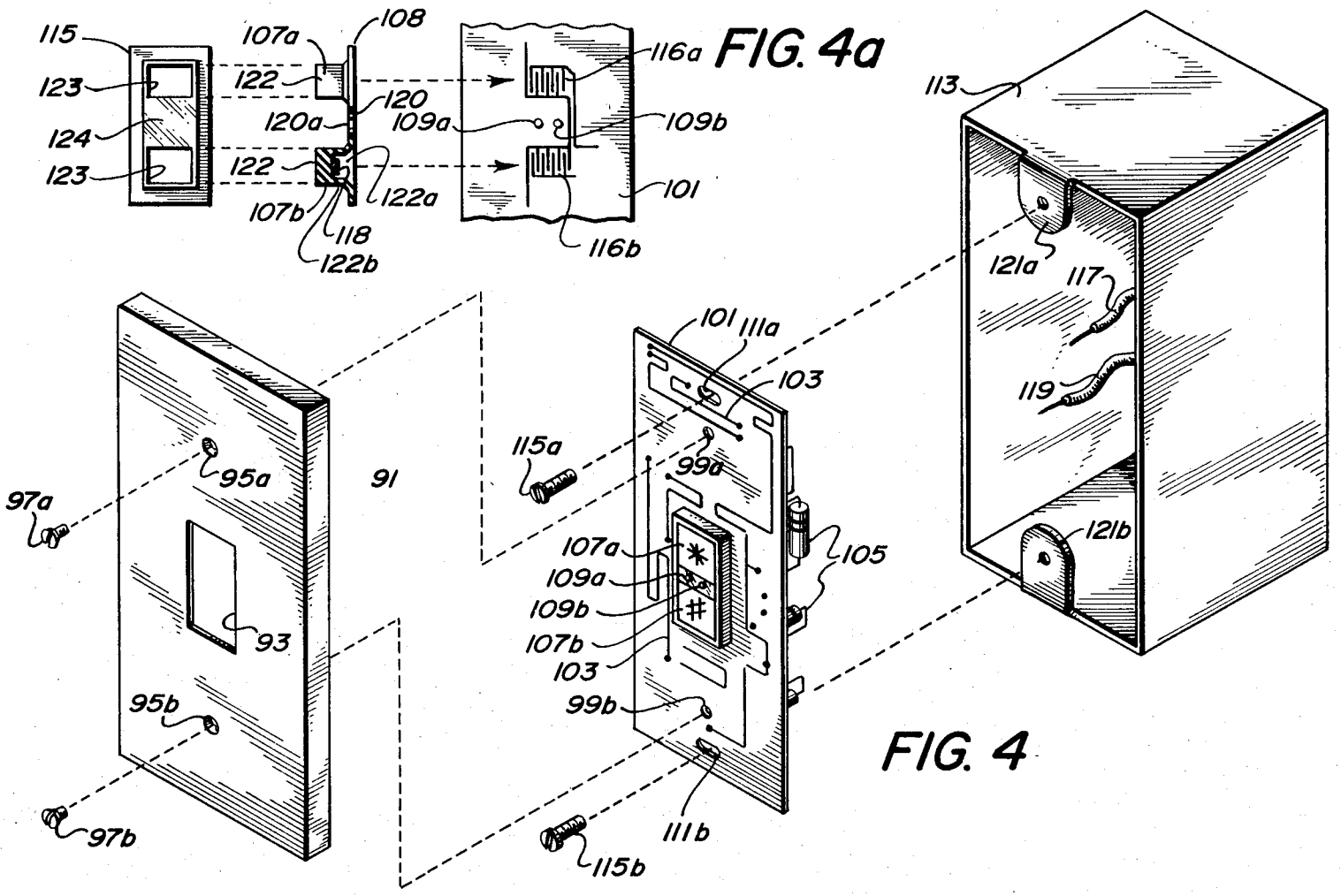
FIG. 4 is an isometric view of a partially disassembled security device in accordance with the invention.

FIG. 4 is an isometric view of a partially disassembled access control device in accordance with the invention in which the standard switch plate 91 is provided with a toggle switch orifice 93 and two fastening holes 95*a* and 95*b* through which threaded fastenings 97*a* and 97*b* will, when the unit is assembled, extend into threaded orifices 99*a* and 99*b* in screw nut type fastenings mounted upon the surface of a printed circuit board 101. Printed circuit board (PCB) 101 has printed circuits 103 on the side facing the switch plate 91 and electronic components generally identified as 105 mounted on the opposite side. Two pushbutton type electrical contacts 107*a* and 107*b* are mounted on the side of the PCB away from the electronic components 105 in such position as to extend through the toggle switch opening 93 when the switch plate 91 and PCB 101 are secured together by the threaded fastenings 97*a* and 97*b*. Preferably two light emitting diodes (LED's ) 109*a* and 109*b* are positioned between the two push buttons 107*a* and 107*b*. The LED's, however, as explained previously, could also be mounted above or below the push-button contacts 107*a* and 107*b*, the central position being preferred because it provides a more balanced and aesthetic appearance and provides additional roo between the push buttons which may facilitate operation by persons with large fingers.

The PCB 101 is sufficiently thick to have a certain structural rigidity, particularly when secured to, or mounted upon, the switch plate 91. Fastening orifices, or slots, 111*a* and 111*b* are provided in PCB 101 by which the PCB may be mounted in the usual electrical wall box 113, sometimes referred to as outlet, junction or other type box, which has previously been mounted in the wall as well known to those skilled in the art. The PCB is fastened to the wall box 113 by threaded fasteners 115*a* and 115*b*.

In mounting the security device of the invention in the wall box 113, electrical power and output leads 117 and 119 are first connected to appropriate electrical connections on the PCB 101 and the PCB is then fastened by threaded fastenings 115*a* and 115*b* to the fastening brackets 121*a* and 121*b* in the wall box 113. The threaded fastenings 115*a* and 115*b* pass through slots 111*a* and 111*b* in the PCB 101 and into the brackets 121*a* and 121*b*, the slots 111 providing some play or adjustment of the PCB. The wall plate 91 is then fastened to the PCB 101 by means of threaded fastenings 97*a* and 97*b* which pass through fastening orifices 95*a* and 95*b* in the wall plate and are threaded into the screw nuts 99*a* and 99*b* in the PCB.

It will be understood that when the security device of the invention is mounted in the wall box 113 as explained above, the PCB 101 serves as a structural member supporting not only the electronic components 105, but also the switch plate 91. When the switch plate 91 is secured to the PCB by the fastenings 97*a* and 97*b*, the switch plate and the PCB form a mutually reinforced structural unit which has a very significant structural rigidity. It will be understood, of course, that the switch plate 91 may be formed from any of the standard materials for such plate such as plastic, steel sheet, aluminum and the like. Likewise the PCB may be formed from any of the usual dielectric substances such as fiberboard, plastic and the like, but will as indicated above preferably have sufficient thickness to provide a significant degree of structural strength and rigidity. Preferably the PCB 101 is formed of fiberglass reinforced plastic resin.

If, as will frequently be the case, the wall plate and the PCB are sold together as an integral unit, which may already be fastened together, it will be necessary to remove the plate from the PCB at least partially before fastening the PCB 101 in the wall box 113.

It should also be noted that since the security device of the invention operates at a low voltage, the electrical code of many communities will not require it to be mounted in a conventional electrical wall box or other independent containment means. In such cases, if desired the PCB may be mounted directly over a hole in the wall— which can easily be done since the electronic components 105 are centralized on the PCB— and fastened to the wall by screw or other type fastenings passed through the fastening orifices 111*a* and 111*b* or by other suitable fastening means. The switch plate 91 may then be fastened directly to the PCB 101 by the fastenings 97*a* and 97*b*. Because of the low voltage also if a wall box 113 is used it will usually not require any external grounding.

It is preferred to mark the push-buttons with some distinguishing identification such as shown in FIG. 4, both for decorative effect and to aid in differentiation between the two buttons. However, such marking is by no means necessary. The use of the asterisk (*) and number symbol (#) as shown is, of course, completely arbitrary.

FIG. 4(*a*) shows a further partial view of the printed circuit board 101 with the push button contacts disassembled to show a preferred electrical contact arrangement. In FIG. 4(*a*) a plastic bezel 115, which mounts the push buttons 107*a* and 107*b* to the printed circuit board, has been lifted away from the circuit board 101 releasing the push buttons. The push buttons 107*a* and 107*b* are likewise shown lifted from the board and rotated ninety degrees to the left revealing the printed circuit contacts 116*a* and 116*b* on the PCB 101 under the assembled location of the buttons. These contacts 116*a* and 116*b* are preferably gold plated interdigitated printed traces with a plurality of side by side circuit traces as shown in FIG. 4(*a*). The upper or outer sections 122 of the push buttons are composed of a hard but flexible rubber composition, while the lower portions are in the form of a hollow cup 122*a* of the same composition. The inner edges or sides 122*b* of the cup 122*a* contact the PCB 101 about the outside of the plated contacts 116*a* and 116*b*. When the buttons are not depressed the resilient sides 122*b* of the cup 122*a* press the button structure away from the contacts 116*a* and 116*b*. Upon depression of the push buttons, however, the sides or inner edges 122*b* of the cup are compressed and electrically conductive rubber buttons 118 within the inner or bottom portions of the cups are forcibly contacted against the plated contacts 116*a* and/or 116*b* electrically bridging such contacts with the electrically conducting rubber composition and allowing current to flow. The interdigitated plated circuit contacts 116*a* and 116*b* provide an excellent conductive path for current flow across the circuit when bridged by the conductive rubber composition of the buttons 118. The plastic bezel 115 has two rectangular or square orifices 123 for the push buttons 107*a* and 107*b* and a transparent plastic section 124 through which the LED's 109*a* and 109*b* are visible when illuminated. The LED's preferably are mounted on the back of the PCB 101 and shine through two suitable orifices in the PCB. As shown a rubber web 120 may connect the two push buttons 107*a* and 107*b* and two orifices 120*a* are provided in the web aligned with the holes in the PCB and through which the LED's 109*a* and 109*b* are visible through the transparent plastic section 124.

Figure 5:
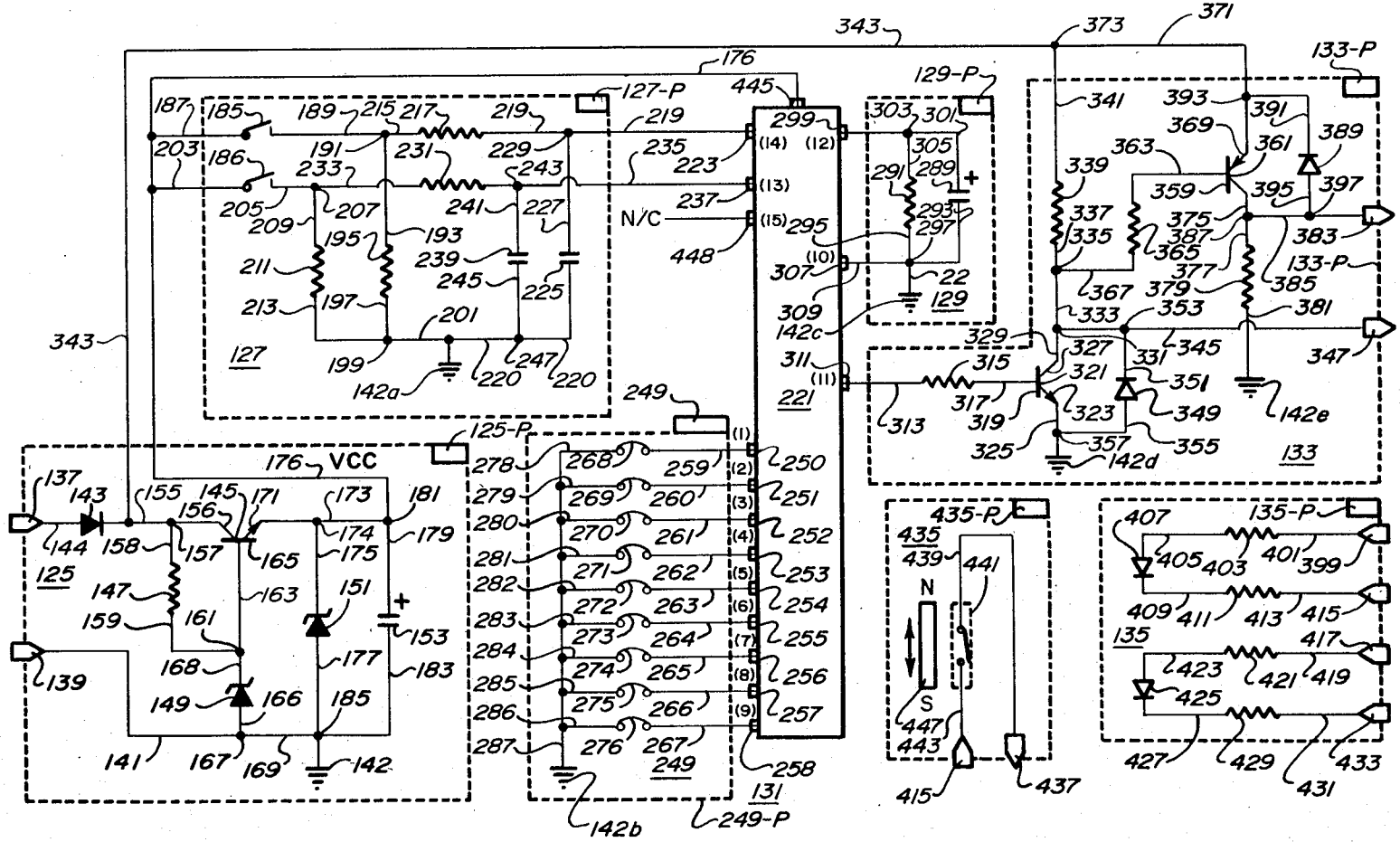
FIG. 5 is a circuit diagram of the electronic components of the security system.

FIG. 5 is a circuit diagram of the operational portions of the security or access control device of the invention. The self-contained access control device is comprised of or utilizes eight principal circuit components, namely, a voltage regulator 125, an input circuit network 127, a timing network 129, logic section 131, output section 133 and LED indicating section 135. A separate tamper circuit described hereinafter is also provided. A separate coding section will as hereafter described also usually be used.

The voltage regulator 125 comprises direct current power leads 137 and 139 which are connected to any suitable source of, for example, 6 to 12 volt D.C. power. Negative lead 139 is connected via a conductor or conductive path, which may preferably comprise a printed circuit trace (PCT) 141, directly to negative ground reference (NGR) 142. Positive power lead 137 is connected directly to a diode 143 by printed circuit trace 144. The protection diode 143 is preferably used to prevent circuit damage in case of inadvertent incorrect hookup or connection of the DC power source to the leads 137 and 139. A series pass transistor 145 is provided to decrease any excess input voltage to a safe level that can be withstood by the circuitry. A resistor 147 and a Zener diode 149 serve to provide the voltage regulator with a stable reference voltage which may be of the order of 6.3 volts. A second Zener diode 151 serves as diode clamp which protects the circuit from possible voltage spikes. A filter capacitor 153 serves to eliminate undesirable AC ripple. The protection diode 143 is directly connected through printed circuit trace (PCT) 155 to the collector 156 of the series pass transistor 145, which is an N-P-N transitor. The protection diode 143 is also connected via PCT 155, junction 157 in PCT 155, and PCT 158 with the resistor 147 which is also connected via a PCT 159, junction 161, and PCT 163 with the base 165 of the series pass transistor 145. The anode of Zener diode 149 is connected via PCT 166, junction 167 and PCT 169 to negative ground reference (NGR) 142 while the cathode is connected via PCT 168 to junction 161. The combination of the resistor 147, Zener diode 149 and PCT connections 158, 159 and 166 and 168 form a stable voltage reference circuit for the voltage regulator 125, which may be referred to as a series pass transistor voltage regulator circuit (SPTVR) 125 shown generally within the dotted perimeter or outline designated 125-P. The emitter 171 of series pass transistor 145 is connected via PCT 173 and junctions 174 and 181 to VCC line 176 and also via PCT 173, junction 174 and PCT 175 to the cathode of Zener diode clamp 151. The anode of Zener diode clamp 151 is connected via PCT 177 and junction 185 to NGR (negative ground reference) 142. As indicated by its designation above, Zener diode 151 clamps any excess voltage spikes to a safe level. Capacitor 153 is connected at its positive terminal via PCT 179 to junction 181 between VCC line 176 and PCT 173 connected to emitter 171 of transistor 145. Thus the positive terminal of capacitor 153 is connected to VCC 176 and also the emitter of transistor 145. The negative terminal of capacitor 153 is connected to NGR 142 through PCT 183 via junction 185. Alternating current ripple entering SPTVR (series pass transistor voltage regulator circuit) 125 at lead 137 is filtered by capacitor 153. The SPTVR circuit serves overall to adjust the voltage in the access control unit to be suitable for operation of the remainder of the circuits of the access control device of the invention.

The input circuit network or section 127 is shown generally within the dotted line perimeter 127-P in FIG. 5. One contact of a single-pole-single-throw (SPST) normally open push button switch 185 is connected to VCC regulated voltage line 176 via PCT 187. The other contact of push button 185 is connected via PCT 189, junction 191 and PCT 193 to resistance 195 which is in turn connected via PCT 197, junction 199 and PCT 201 to NGR (negative ground reference) connection 142*a*. (The negative ground is in each case designated as 142 with, except in the case of voltage regulator circuit 125, a letter designation to indicate the particular connection, in this case 142*a*. ) Resistance 195 provides a negative reference and a path to ground for static voltage that may be conducted through push-button contact 185. Switch contact 185 will normally be comprised of the interdigitated plated circuit contact 116*a* and the conductive section 118 of the push button 107*a* shown in FIGS. 4 and 4*a*.

The second SPST push-button switch 186 is also connected at one contact via a PCT 203 to the VCC regulated voltage 176 and at its other contact via PCT 205, junction 207 and PCT 209 t resistance 211 which is in turn connected via PCT 213 to junction 199 and then through common PCT 201 to NGR connection 142*a*. As in the case of push-button switch 185 and resistance 195, the resistance 211 provides a negative reference and a path to ground for static voltages that may be conducted through push-button switch 186.

The two push buttons 185 and 186 preferably may consist essentially of a conductive rubber key as known in the art, and shown in FIG. 4(*a*), connected to or held upon the PCB (printed circuit board) by a clear plastic bezel, also as shown in FIG. 4(*a*). It will be understood that the contact 186, like contact 185, preferably comprises the printed circuit contact 116*b* and conductive section 118 of push button 107*b* shown in FIG. 4(*a*).

The junction 191 is also connected via a PCT 215 to a resistance 217 which serves to limit current passing via lead 219, which preferably also comprises a PCT lead, into the major circuit component of the controlled access device of the invention, i.e. the integrated circuit 221, via pin connection 223. A capacitor 225 is connected at one terminal via a PCT 227 with a junction 229 in PCT lead 219. The other side or terminal of capacitor 225 is connected with NGR connection 142*a* via PCT 220. The combination of the resistances 195, 217 and the capacitance of capacitor 225 provides an RC time constant which eliminates the effects of switch bounce, i.e. variable current caused by variations in contact pressure, occurring at push-button switch 185. Pin connection 223 of integrated circuit component 221 is connected as shown to the upper push-button contact 185 which as indicated above may be the conductive contact of the upper push button 107 *a* shown in FIG. 4 and marked for convenience with an asterisk (*).

A resistance 231, comparable to the resistance 217 connected to push-button contact 185, is connected via PCT 233 to junction 207 and PCT 205 to push-button contact 186. The resistance 231 is also conncted via PCT 235 to pin connector 237 of integrated circuit (IC) 221. A capacitor 239, comparable to capacitor 225, is connected at one terminal via PCT 241 to a junction 243 in PCT 235 and is connected at the other terminal via PCT 245 to junction 247 in PCT 220 and then via PCT 220 to NGR 142*a* . As before the combination of the resistances 211 and 231 and the capacitance of capacitor 239 form an RC time constant which eliminates the effects of any switch bounce occurring at push-button contact or switch 186. Pin connector 237 is connected by the circuits described as may be seen in FIG. 5 to the lower push-button contact 186 which may be lower push button 107*b* shown in FIG. 4 designated or marked for convenience with the number symbol (#). Such designation, or designation with some other suitable or desired symbol, as will presently be seen, facilitates operation as well as explanation of the code operation.

The integrated circuit 221, which is an encapsulated self contained solid state circuit, is the heart of the logic section 131 of the access control device of the invention and has the usual metal strip contacts or pins for connection to other circuits and leads such as, for example, the pins 223 and 237 mentioned above. The IC 221 is provided with the usual pins conventionally enumerated (1) through (16) shown in parenthesis and individually identified by serial identifying numerals such as 223 and 227 as specified above.

The integrated circuit 221, the operation of which will be more fully described in connection with FIG. 6, has, as shown in FIG. 5, a connected coding section 249 diagrammatically shown within dotted perimeter 249-P in FIG. 5. A series of 9 pins 250, 251, 252, 253, 254, 255, 256, 257 and 258 provided on the integrated circuit 221, which are the conventionally number pins (1) through (9) of the integrated circuit, are connected via PCT's 259, 260, 261, 262, 263, 264, 265, 266 and 267, to corresponding jumper wires 268, 269, 270, 271, 272, 273, 274, 275, and 276, each of which is connected at its opposite end via corresponding PCT's 278, 279, 280, 281, 282, 283, 284, 285 and 286 to NGR connection 142*b* by a common lead 287 or by other suitable connection. The jumper wires 268–277 determine the operating code sequence. Cutting or severing one or more of the jumper wires 268–277 sets the operating code sequence. Cutting one of the jumper wires 268–276 allows the corresponding input pin 250–258 to become positive as the result of internal pull-up resistors located within the IC 221. The positive voltage level represents a "logic one" to the IC 221 and programs a number (#) into the code. A more detailed explanation of the operation of the code section will follow hereafter.

The timing network 129 which is shown within dotted perimeter or outline 129-P is comprised of capacitor 289 and resistor 291 in the usual parallel circuit relationship. One side of capacitor 289 and one side of resistor 291 are connected to NGR connection 142*c* by respective PCT's 293 and 295 through junction 297. The other side of the capacitor is charged by pin 299 of IC 221 via PCT 301. Capacitor 289 is charged by pin 299 to a positive voltage level and discharges via PCT 301, through resistor 291, junction 303 and PCT 305. The time it takes to discharge capacitor 289 constitutes the time window during which a code sequence must be entered into the system by means of the push buttons. The "time window" may also be called the "lockout time" or the "output time". It will be noted that pin 307 of ICT 221 is also connected via PCT 309 and junction 297 to NCR connection 142C.

An output section 133 shown generally within dotted perimeter or outline 133-P in FIG. 5 is provided for generating a signal that can be used to disarm a security system by operating a relay or the like or can operate a relay to apply power to a solenoid or other electromechanical means to operate a latch or lock. Pin 311 of IC 221 is connected by PCT 313 to resistor 315 of output circuit section 133. The other end of resistor 315 is connected via PCT 317 to the base 319 of an NPN transistor 321. Emitter 323 of transistor 321 is connected by PCT 325 to NGR connection 142*d*. The collector 327 of transistor 321 is connected via PCT 329, junction 331, PCT 333, junction 335 and PCT 337 to pull up resistor 339. Resistor 339 is in turn connected at its other end via PCT 341 to supply voltage lead 343. Collector 327 of NPN transistor 321 is also connected via PCT 345 to output lead connection 347. A diode 349 is connected on its cathode side to collector 327 of transistor 321 via PCT 351, junction 353 as well as PCT 345 and junction 331. The anode side of diode 349 is connected via PCT 355 and junction 357 to NGR connection 142*d*. The base 359 of a PNP transistor 361 is also connected via PCT 363, resistor 365 and PCT 367 via junction 335 to PCT 333. Resistor 365 is thus connected to the base 359 of transistor 361 and is in turn connected by junction 331 between PCT's 329 and 333. Emitter 369 of transistor 361 is connected via PCT 371 and junction 373 to supply voltage lead 343. The collector 375 of PNP transistor 361 is tied low to NGR connection 142*e* through PCT 377, resistor 379 and PCT 381. Output lead 383 is connected via PCT 385 and junction 387 to collector 375 via PCT 377. A diode 389 is connected across the emitter 369 of transistor 361 and the output lead 383 by PCT 391 and junction 393 on its cathode side and by PCT 395 and junction 397 on its anode side.

The access control device of the invention also preferably incorporates a light emitting diode (LED) section 135 shown in FIG. 5 contained within the broken perimeter 135-P. An input lead 399 is connected via PCT 401 to one side of resistance 403 which is in turn connected via PCT 405 to the anode of LED 407. The opposite cathode side of LED 407 is connected via PCT 409 to resistance 411 which is in turn connected via PCT 413 to input lead 415.

In a similar manner input lead 417 is connected via PCT 419 to resistance 421 which is in turn connected via PCT 423 to the anode of LED 425, the cathode side of which is connected via PCT 427 to one side of resistance 429, the other side of which is connected via PCT 431 to input lead 433. The invention also preferably incorporates a tamper detection circuit 435 shown within broken perimeter 435-P in FIG. 5. An output lead 437 is connected via PCT 439 to one side of a reed switch 441. The other side of the reed switch 441 is connected via PCT 443 to input lead 415. Adjacent to the reed switch is a magnet 447 conveniently attached to the switch plate 101 shown in FIG. 4. The tamper section 435, although mounted on the PCB, is not electrically connected to the other circuits of the access control system. As will be understood, if an unauthorized person tries to gain access to the security system by removing the switch plate 101, they will at the same time remove the magnet 447 from the vicinity of switch 441 and open said switch setting off any suitable alarm, not shown.

The IC 221 is connected via its pin 10, designated by identification 445, to PCT 176 which constitutes VCC power source lead 176. Pin (15) designated by identification numeral 448 has no connection, since this pin has no use in the presently described arrangement.

Figure 6:
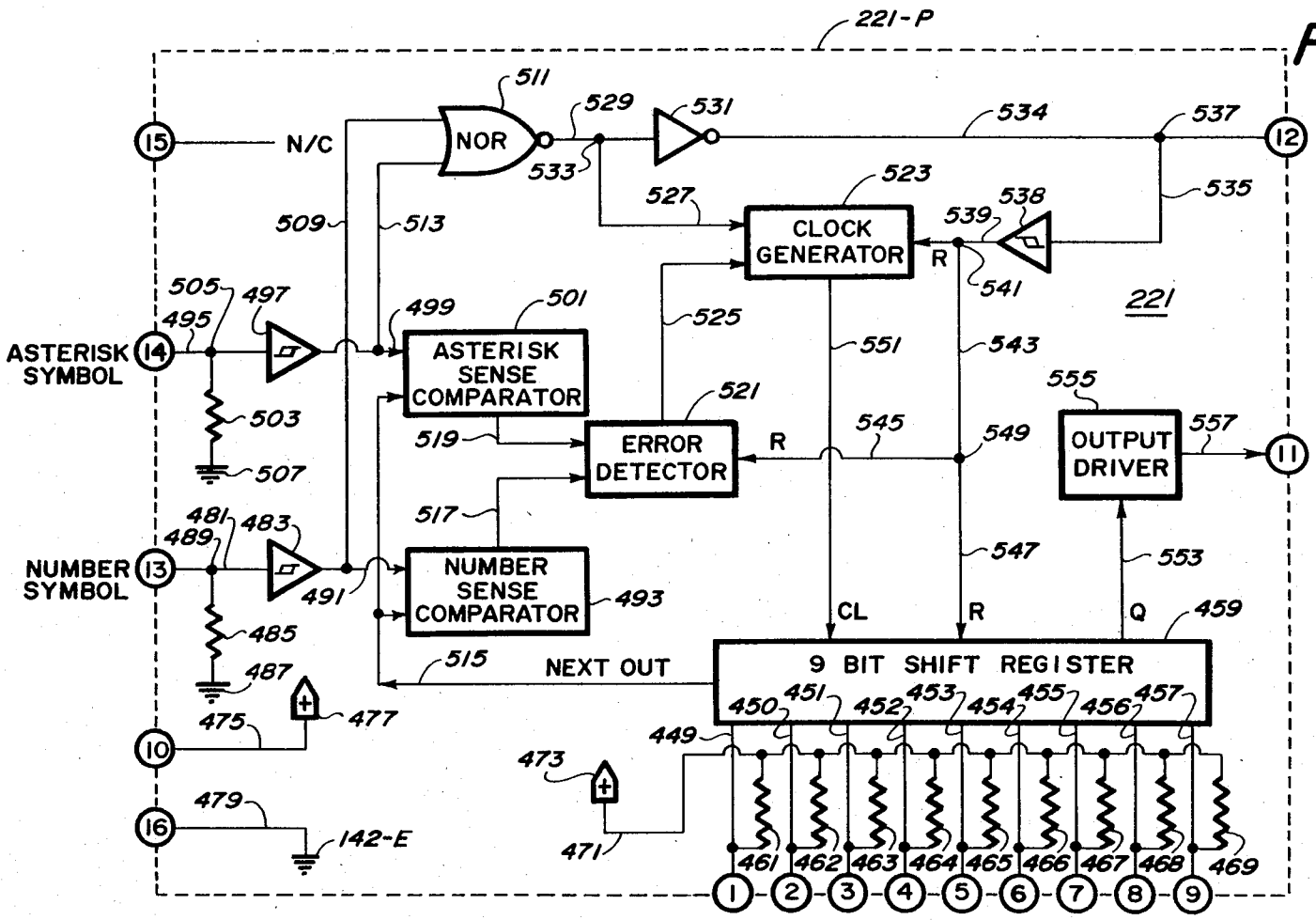
FIG. 6 is a circuit diagram of the logic portions of the securing system of the invention.

FIG. 6 is a block diagram of the operational units preferably contained in the integrated circuit (IC) 221 shown in FIG. 5. The broken perimeter 221-P indicates diagrammatically the outer extremities of the IC device. The various pins of the IC are conventionally numbered 1 through 16 shown in circles partly within and partly without the perimter P of 221-P, each of said pins being diagrammatically represented as a circle within which is shown the number of the pin or connection strip. For example, pins 1–9 in FIG. 6 are the same as pins 250–258 shown in FIG. 5. Each of the pins 1–16 serves as either an input or output connection for the IC. The pins 1–9 serve as the coding inputs to the IC 221 and are connected via appropriate circuit traces 449 through 457 to a 9 bit shift register 459. Each of the circuit traces 449 through 457 is also connected in the usual manner to resistances 461 through 469 which are connected at their other ends to common circuit trace 471 which is connected to a positive power lead 473.

Pin (10), designated by identification numeral 445 in FIG. 5, of IC 221 is connected to VCC voltage source 176. This pin, therefore, has a positive voltage which is connected via PCT 475 to positive power lead 477, which, it will be understood, is connected in any suitable manner to positive power lead 473. The pin 16 is connected to NGR 142-E via PCT 479. Pin 15, identified in FIG. 5 by numeral 448, is, as there indicated, not connected to a circuit in the arrangement shown.

Pin 13 is connected within IC via circuit trace 481 to a Schmitt trigger buffer 483. A resistance 485 is connected to a ground 487 and a junction 489 in circuit trace 481. The pin 13 externally is connected to pushbutton contact 186 as shown in FIG. 5. The output of Schmitt trigger buffer 483 is connected via circuit trace 491 to voltage sense comparator 493 denoted "number sense comparator" which is driven by voltage from the pushbutton contact 186 of FIG. 5 the actuating button of which is marked as in FIG. 4 with a number symbol.

A similar circuit arrangement is connected internally to pin 14, which, as shown in FIG. 5, where it is designated as 223, is connected externally to PCT 219 and hence to pushbutton contact 185 of FIG. 5 the actuating button of which is marked as in FIG. 4 with an asterisk.

Internally pin 14 is connected via circuit trace 495 to Schmitt trigger buffer 497 which is in turn connected via circuit trace 499 to voltage sense comparator 501 denoted "asterisk sense comparator" because the pushbutton contact 185 is operated by a push button marked with an asterisk. As before a resistance 503 is connected between a junction 505 in circuit trace 495 and a ground 507.

A circuit trace 509 connects circuit trace 491 leading from Schmitt trigger buffer 483 to voltage comparator 493 with a NOR gate 511 and circuit trace 513 connects circuit trace 499 leading from Schmitt trigger buffer 497 to voltage sense comparator 501 with NOR gate 511. A circuit 515 also leads from shift register 459 to voltage sense comparators 493 and 501. Circuit traces 517 and 519 respectively lead from voltage sense comparators 493 and 501 to error detector 521. The error detector 521 feeds a signal to clock generator 523 over circuit trace 525 and clock generator 523 also receives a signal from NOR gate element 511 via circuit trace 527 through circuit trace 529 which leads to inverting amplifier 531 via junction 533. A circuit trace 534 connects the opposite terminal of inverter or NOR element 531 with pin 12 and hence with the external timing circuit 129 shown in FIG. 5. A circuit trace 535 connects junction 537 in circuit trace 534 with Schmitt trigger buffer 538 which in turn is connected by circuit trace 539 to clock generator 523 and also via junction 541 and circuit traces 543 and 545 to error detector 521. A further circuit trace 547 leads from junction 549 to shift register 459 at input R. A still further circuit trace 551 connects clock generator 523 to shift register 459 at input CL.

A circuit trace 553 connects output Q of shift register 459 with an output driver 555 which is in turn connected with pin 11 of IC 459 by circuit trace 557. Pin 11 is connected externally with the output circuit section 133 shown in FIG. 5.

Figure 7:
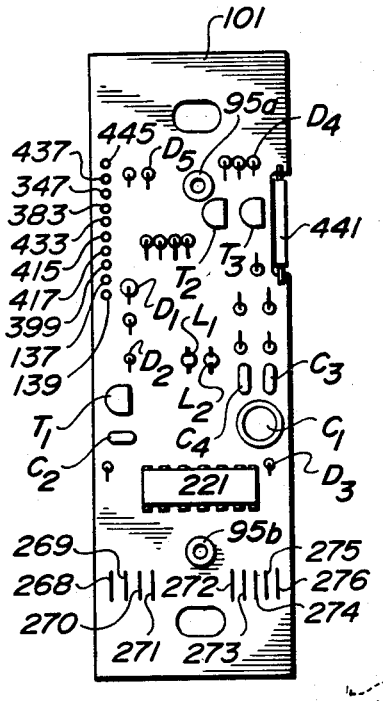
FIG. 7 is a rear view of the security device of the invention showing the arrangement of the electronic components on the printed circuit board and the code jumper wires by which the code of the device is determined.

FIG. 7 is a diagrammatic view of the rear of the access control device of the invention showing the various electronic components mounted upon the printed board 101. The general arrangement of the various components is shown including the IC 221 and in particular the jumper wires 268 through 276 near the bottom of the PCB where they can be conveniently cut by a small pair of wire cutters or the like to set the code sequence which will be recognized by the IC 221. At the upper left of the printed board 101 are the various leads and external connections of the board. The reed switch 441 is seen at the upper right hand side of the PCB 101. Threaded fastening nuts **95*a* and 95*b* are in the upper and lower portions. The various electronic components such as transistors T1–T3, capacitors C1 and C2, diodes D1–D3 and resistors R1–R14 are also shown. Green and red LED's L1 and L2 are also shown. These are the same components shown in the circuit diagram 5, although such components have not been specifically identified by operational number in FIG. 7 since their interconnections by printed circuit traces are on the opposite side of the printed circuit board and the specific arrangement of the electronic parts shown in FIG. 7 is more a matter of convenience than necessity. The push button contacts of the access control device do not appear in FIG. 7 since these are mounted on the opposite side of printed circuit board 101 as shown in FIG. 4**.

A person wishing to operate the access control device of the invention must first know where to locate the code buttons 107*a* and 107*b* shown in FIG. 4, i.e. such person must either know where the buttons are mounted or must be familiar enough with such devices so that he will recognize the installation after a quick surveilance of the area. He or she must then press one or both of the push buttons 107*a* and 107*b* in a correct code sequence predetermined by the jumper wires 268–276, some of which will have been previously severed as explained above and in greater detail hereinafter.

Activation of push buttons 107*a* and 107*b* momentarily closes push-button contacts 185 and 186 shown in FIG. 5 providing controlled voltage from VCC line 176 via voltage regulator 125 to IC pins 13 and 14 (designated 237 and 223) via input circuit section 127. In the voltage regulator section an external DC power source is provided across power leads 137 and 139. Protection diode 143 on the positive power lead prevents circuit damage in case of incorrect terminal hookup of the power source, while series pass transistor 145 serves to drop any excess input voltage to a safe level for the circuit components involved. Resistor 147 and Zener diode 149 provide the voltage regulator with a stable reference voltage of, for example, 6.3 volts. Zener diode clamp 151 meanwhile serves to protect the circuit from voltage spikes. Filter capacitor 153 serves to eliminate any unwanted alternating current ripple.

The VCC stable source voltage is applied via conventional positive VCC lead 176 and push-button contacts 185 and 186 to input circuit section 127 either at junction 207 between resistors 211 and 231 or the junction 191 between resistors 195 and 217, depending upon which push button is depressed. Resistors 211 and 195 provide a negative reference and a path to negative or ground 142*a* for any unwanted stray static voltages conducted through the push-button contacts 185 or 186. Resistors 217 and 231, on the other hand, limit current passed into the integrated circuit logic chip (IC) 221 and together with the capacitors 225 and 239 respectively form an RC time constant or delay which serves to "debounce" the signal provided via the push buttons 185 and 186. The time delay may preferably be, as an example, about 0.001 second or one millisecond. The time delay provided by the input circuit components is not necessary for operation under ideal conditions, for example, under laboratory conditions, but has been found necessary for the access control circuits of the invention under field conditions and protects and enhances the operation of the device of the invention.

In addition to the timing function of the input circuit section 127, the timing circuit section 129 starts a "time window" or period having a time duration equal to (x) where the value of (x) is determined by the values of the capacitor 289 and resistance 291. This time window or period starts when one of the push-button contacts 185 or 186 is released after having been activated. If the next button pressed is the correct button according to the preset code, such time window or period will be extended for an additional period (x), but (x) does not accumulate. This means that whenever a correct button is pressed, the next correct button must be pressed or activated within a time period of (x). On the other hand, if an incorrect button sequence is activated a so-called lockout time equal to (x) invalidates any push-button signal entry for a time period (x). When the last correct button is pressed, the output will also be equal to (x) starting when the last correct activation of the button is released.

Voltage applied via resistor 217 to pin 13, designated 237, of IC 221 upon depression of push-button switch 185 is limited by the resistor, but rises to a "logic one" in the time period set by the resistance 217 and capacitor 225 in the RC circuit. Upon reaching the threshold voltage of pin 14 (237) the input of IC will recognize a "logic one."In the same manner voltage applied via resistor 231 to pin 15, designated 237, of IC 221 upon depression of push-button switch 186 is limited by the resistor, but rises to a "logic one" in the time period set by the resistance 231 and capacitor 239 in the RC circuit. Upon reaching the threshold voltage of pin 14 (237) the input of the IC will recognize a "logic one."

The push-button contacts 185 and 186 must be activated in an exact predetermined sequence which must total nine (9) button depressions. The exact sequence or order in which the buttons are pressed is determined by a programmable code set by the installer of the access control device. This code is set by cutting small wire jumpers 268–276 located upon the PCB 101 within the coding section 249, which jumpers may be numbered one (1) through nine (9). Assuming that the push buttons are marked with a number symbol (upper button) and an asterisk (lower button), cutting any jumper programs a number symbol (#) into the code. If no jumpers are cut, the code would remain nine (9) depressions of the asterisk (*). If jumpers 3, 7 and 9, i.e. 270, 274 and 276, are cut, the code would be as follows:

Two depressions of the asterisk (*) Depressions 1, 2
One depression of the number symbol (#) Depression 3,
Three depressions of the asterisk (*) Depressions 4, 5, 6
One depression of the number symbol (#) Depression 7,
One depression of the asterisk (*) Depression 8,
One depression of the number symbol (#) Depression 9

The code example given above could also be expressed by #*#*#. There are 512 possible codes, mathematically expressed as ($A^n$) i.e. A to the nth power, where A is the number of digits and (n) is the number of depressions that must occur for a valid code. The correct insertion of a code into the device results in a positive going or negative going voltage transition, depending which output is chosen, that can be used to control another device, typically an alarm system or electronic gate or door. If an incorrect out-of-sequence button is pushed, an automatic "lockout" time will reset the counter to zero and also prevent any correct button entry from advancing the count until the lockout time has elapsed. Lockout time is a fixed value determined by two components in the circuit as explained above.

The LED indicators 109*a* and 109*b* shown in FIG. 4 positioned between the * and # buttons 107*a* and 107*b* may be used to indicate that a change in alarm status has occurred, but these LED indicators also shown in FIG. 5 as circuit components 407 and 425 are not necessary to the function of the device. The LED's are passive in the sense that they only indicate the current status of another portion of the system or device. Thus they may be connected to any suitable portion of the circuits of the access control device of the invention to provide an indication of the condition of such device. For example, a green LED may be connected across the power leads 137 and 139 to indicate that power is being applied to the voltage regulator section. A red LED, on the other hand, may be connected between output lead 347(−) and input lead 137(+) or across input lead (139(−) and output lead 383(+).

The integrated circuit 221, shown generally in FIG. 5 and in more detail as to its internal elements in the block diagram shown in FIG. 6, operates as follows. A positive potential, referenced to lead strip or pin 16 VDD, of between 2.5 volts and 15 volts, must be applied to pin 10 VSS. Positive input voltage pulses applied via push-button contact 185 and input circuit section 127 are applied via PCT 219 to pin 14 and similar positive input pulses are applied via PCT 235 from push-button contact 186 to pin 13. These positive pulses which represent a "logic one" pulse respectively from the asterisk (*) and number (#) push buttons 107*a* and 107*b* shown in FIG. 4 are initially conditioned by the Schmitt trigger buffers 483 and 497. NOR gate 511 detects when either input is active—that is to say a logic one and the voltage sense comparators 501 and 493 detect which input is active. Error detector 521 functions to determine if the correct input is the active input. A clock pulse is generated by clock generator 523 when the error detector 521 indicates via circuit trace 525 that the correct input is active. The clock pulse is applied via circuit trace 551 to the shift generator 459 and advances the "next out" signal via circuit trace 515 to the voltage sense comparators 501 and 493 which are thereby set up for the next input condition at pins 13 or 14. When shift register has advanced its count to a total of 9, the "Q[ output of the shift register becomes active and is buffered by output driver 555 resulting in an output voltage at pin 11. When a correct input is applied to pins 13 or 14, the external RC timing circuit 128 connected to pin 12 charges to a logic one condition. A logic one condition at the input to Schmitt trigger buffer 538 allows the IC to function by providing a valid data condition at point R for a period of time set by the RC network. Coding input pins 1 through 9 sets the nine digit code that determines the "next out" bit pattern applied to voltage sense comparators 501 and 493.

The occurrence of an active logic output (logic one) at pin 11 of IC 221 causes current to flow through PCT 313, resistor 315 and the base 319 of NPN transistor 321. Emitter 323 of transistor 321 is conaected to NGR ground 142*a*. Collector 327 of transistor 321 is connected to supply voltage 343 via pull-up resistor 339 and PCT 341. Collector 327 of transistor 321 is connected to output lead 347. The output lead 347 switches from a positive voltage to NGR 142(*e*) when an active output occurs at pin 11 of IC 221, The cathode of diode 349 is connected to collector 327 through PCT 351. The anode of diode 349 is connected by PCT 355. to NGR 142*d* and emitter 323 of transistor 321. Diode 349 protects transistor 321 from voltages exceeding the reverse voltage specification of transistor 321 by clamping negative transient voltages to NGR 142(*d*). An active output at pin 11 of IC 221 also causes current to flow through PCT 367, resistor 365 and base 359 of PNP transistor 361. PCT 367 is connected to PCT 333 via junction 335. Emitter 369 is connected to supply voltage 343. Collector 375 is tied low to NGR 142*e* through resistor 379. Output lead 383 is connected to collector 375 through PCT 385 and switches from NCR 142*e* to a positive voltage when an active output occurs at pin 11 of IC 221. The cathode of diode 389 is connected to emitter 369 through PCT 391. The anode of 389 is connected to output lead 383. The diode 389 protects transistor 361 from voltage that exceeds the reverse voltage specification of transistor 361 by clamping positive transient voltages to supply voltage PCT 343 via PCT 371.

It will be understood that an output voltage appearing across output leads 383 and 347 may be used in various manners in security systems, but is particularly useful for operating a relay such as shown in FIG. 2 to disarm a main panel of a security system or may be used to operate a visual or audible alarm or signal.

Figure 8A:
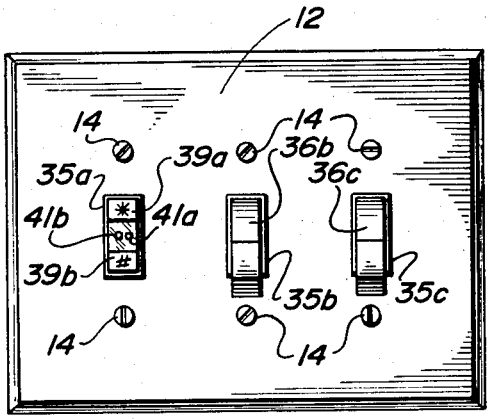
FIGS. 8(*a*) and 8(*b*) are diagrammatic sketches of the access control device of the invention used with a switches, one of which may serve to control the power applied to the access control device of the invention.
Figure 8B:
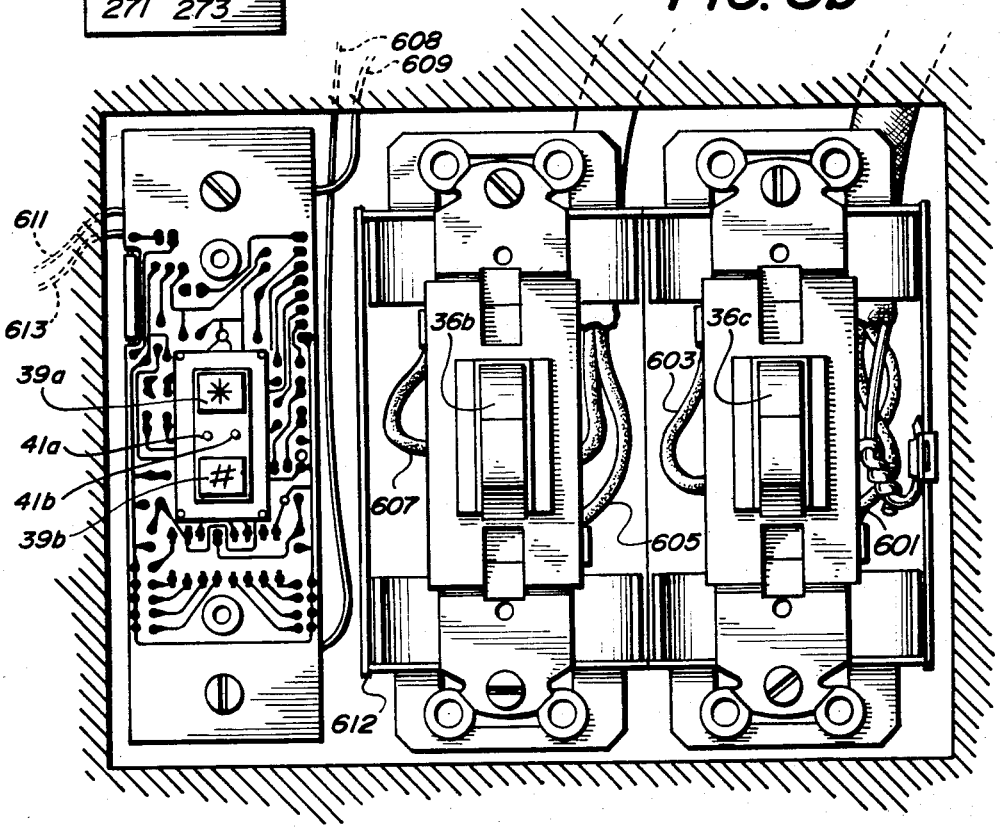

In FIG. 8(*a*) there is shown the face of an access control device in accordance with the invention such as shown in FIG. 1 including a toggle switch plate 12 covering and secured to the wall 13 shown in FIG. 1 by fastenings 14 through intermediate mounting means. A pair of push buttons 39*a* and 39*b* extend through the toggle switch orifice 35*a* on the left side and two normal toggle switches 36*b* and 36*c* extend through the other two toggle switch orifices 35*b* and 35*c*. LED's 41*a* and 41*b* are positioned between the two push buttons 39*a* and 39*b*.

IN FIG. 8(*b*) the interior arrangement of FIG. 8(*a*) is shown with the switch plate 12 removed to show the circuit connections. Power leads 601 and 603 lead to toggle switch 36*c* which may control a normal light element, not shown, and is therefore not further described. Power lead 605 is also connected to toggle switch 36*b* and lead 607 connects also to toggle switch 36*b*. Power leads 601, 603, 605 and 607 are 110 to 120 volt and toggle switches 607 and 609 are contained within wall box 612 as required by most electrical codes. Low voltage power leads 608 and 609 connect to access control device 11. Output leads 611 and 613 extend from access control unit 11 to some other location such as the control panel 25 shown in FIG. 1. Since a low voltage device cannot be under most electrical codes contained in the same wall box with high voltage apparatus, the two toggle switches are preferably contained in a grounded metal 2 switch wall box 612 while the access control device is placed outside the box in an opening in the wall or in a separate box.

The security of the system shown in FIG. 8(*a*) and 8(*b*) may be further increased if the power connection to control device 11 is routed through toggle switch 36*b*. In such case, toggle switch 36*b* must also be positioned outside of the wall box and only low voltage power is passed through it. In other words only a single wall box will be used to contain the toggle switch 36*c* and toggle switch 36*b* and the access control device 11 will be merely mounted in a opening in the wall or in a separate wall box. In this manner the switch 36*b* must be activated before the access control device can be activated at 11. This provides a further degree of security since it adds a further single, but critical, step to activation of the disarming function of the device. Additional security could, of course, be provided by spacing the toggle switch 36*b* from the access control code unit 11 by, for example, placing switch 36*b* in a more remote location in another switch box or even by requiring activation of multiple switches such as the two switches 36*b* plus 36*c* before the access control device may be operated. It will be understood, of course, that the tamper circuit 435 in which the reed switch 441 is contained will be activated at all times so that it will be provided with separate power leads not shown. If power was not provided to this circuit at all times the circuits tamper function would, of course, be compromised.

It will be recognized from the above description and explanation that the access control device of the invention provides practical and effective security and as explained maximizes to the greatest possible extent the principal factors which relate to security while providing an attractive and economic security control system. While the invention, furthermore, has been described with considerable specificity, the invention is to be understood to be capable of variation and is to be limited only by the language of the claims.

I claim:

1. An electronic secturity control device adapted for mounting within a standard wall type electrical switch box protected with a standard toggle switch type wall plate comprising:

(a) a printed circuit board having electrical circuit traces on one side thereof, (b) a pair of substantially adjacent push buttons mounted upon said circuit board on the same side as the electrical traces for activating switch circuits on said printed circuit board by connecting said switch circuits with an electrical power source, said push buttons:

(i) being dimensioned for extension through a toggle switch opening in said standard switch wall plate, and (ii) extending from the printed circuit side of said circuit board, and (iii) having associated therewith switch contact elements for connecting said switch circuits, (c) a series of interconnected electronic circuit components mounted upon the opposite side of said printed circuit board including:

(i) a voltage regulation circuit for electric power supplied to said electronic securing device, (ii) a timing circuit for timing input of coded signals to the security device, (iii) an input circuit connected through the switch contact elements for input of sequentially coded signals, (iv) a logic circuit for detection and comparison of sequentially coded signals supplied through said input circuit, (v) a coding circuit for predetermining the sequential code to be recognized by the logic section, (vi) an output circuit for providing activation current to a security device, (d) wherein the electronic circuit components are interconnected such that (i) the voltage regulation circuit is connected on the one hand with the electrical power source and on the hand in parallel through said electrical circuit traces with the input circuit via the switch contact elements, and independently with the logic circuit and the output circuit, (ii) the logic circuit is additionally connected to the timing circuit, to the coding circuit, and to the output circuit, whereby sequential depression of the push buttons closes the switch contact elements directing electrical pulses from the voltage regulation circuit through the input circuit to the logic circuit which compares such sequential electrical pulses with the sequential code determined by the coding circuit within the time constraint provided by the timing circuit and when a predetermined sequential code signal is detected activates the output circuit to operate external security actuation circuits.

2. An electronic security control device according to claim 1 wherein the input circuit section incorporates debouncing circuit means to debounce the signals received from the push-button switch circuits.

3. An electronic security control device according to claim 1 wherein the timing circuit includes means for:

(i) timing the input of the code sequence and upon failure to detect a predetermined code sequence within a predetermined time to reset the logic circuit so the entire coded sequence must be repeated before a signal is supplied to said output circuit, and (ii) upon detection of the input of an error in the input of at least one element of the sequential code to reset the logic circuit so the entire predetermined code sequence must be repeated before the output circuit is actuated.

4. The electronic security device according to claim 3 additionally comprising a status indication circuit including light emitting diodes positioned adjacent the push butons in cirucits connected to power and output circuits of said device.

5. An electronic security control device according to claim 1 wherein the switch plate and printed circuit board are secured together to form an integral structural unit, said printed circuit board having sufficient thickness to have a rigidity compatible with supporting the switch plate and connecting it to the wall mounting for the device.

6. An electronic security control device according to claim 5 additionally comprising a tamper detection circuit mounted upon said printed circuit board for detection of attempted access to the security device and activating an alarm upon such detection.

7. The electronic security device according to claim 6 wherein the tamper detection cirucit comprises a reed switch mounted upon said printed circuit board and a magnet mounted upon said switch plate adjacent said reed switch.

8. An electronic security control device adapted for mounting in a standard wall type switch box comprising:

(a) a printed circuit board upon which are mounted the circuit components of a coded sequence type electronic securing access system, (b) a standard switch plate designed for use with a toggle type wall switch, (c) a pair of actuating push buttons mounted upon one side of the printed circuit board and connected by printed circuit means to electronic circuit components mounted upon the opposite side of the printed circuit board, (d) the pair of push buttons being mounted upon the circuit board in such position that they extend through the opening provided in the standard switch plate when the switch plate and circuit board are secured to each other by suitable fastening means, (e) the circuit components upon the circuit board including an integrated circuit type coded sequence detection means.

9. The electronic security control device of claim 8 additionally comprising a voltage input circuit, a timing circuit means and an output circuit, said circuits being interconnected and connected to a power source and constructed and arranged whereby sequential depression of the push buttons directs electrical impulses from the voltage input circuit to the integrated circuit type coded sequence detection means which compares such signals with a predetermined code within time constraints determined by the timing circuit and upon recognition of said predetermined code activates the output circuit.

10. A code type securing device comprising:

(a) an electrical box mounted adjacent to a movable closure, (b) a switch plate designed for toggle type switches, (c) a printed circuit board having mounted thereon an electronic code type securing system including two substantially adjacent depressible electric contacts adapted for entering a sequentially coded signal into the securing system, said depressible electric contacts being mounted upon said printed circuit board in a position to extend through a toggle opening of said switch plate, the switch plate and the circuit board being secured together by first common threaded fastenings extending through aligned fastening orifices in both, (d) said printed circuit board and said switch plate being secured to said electrical switch box by second threaded fastenings, (e) an electrical switch circuit extending from said electronic code type securing system in said switch box to solenoid means for a latch means for securing the movable closure means.

11. An electronic sequential code type securing device comprising:

(a) a printed cirduit board having two threaded fastening orifices extending therethrough, (b) a standard toggle type wall switch plate having two standard fastening orifices therein, (c) the threaded fastening orifices of the printed circuit board being the same predetermined distance apart as the two standard fastening orifices in the toggle type wall switch plate, (d) threaded fastening means extending through the standard fastening orifices in the wall switch plate and the threaded fastening orifices in the printed circuit board and fastening the two together in such position that two depressible buttons mounted on the printed circuit board extend through a single toggle switch opening in the standard wall switch plate in operating position such that each is accessible to sequential depression during operation to enter a code signal into an electronic circuit system contained upon the printed circuit board and adapted when a predetermined sequentially coded type signal is entered through a timed depression of the depressible buttons to provide an electrical actuation signal to a security device connected thereto by electrical leads.

12. An electronic access control device for disarming a securing system including a printed circuit board having mounted upon one side two vertically aligned push buttons which activate switch means in an electronic circuit including integrated circuit means adapted to detect and compare a sequential coded signal with a predetermined code pattern, said circuit board being mounted together with a standard toggle switch plate in such position that the two push buttons extend through a toggle switch opening in such plate, an output circuit of said access control device being adapted for connection to a relay designed to deactivate an alarm system upon input into such device of said predetermined code pattern by activation of said switch means, said access control device being adapted for positioning in a secure area upon a wall in conjunction with conventional light switches.

13. The electronic access control device of claim 12 additionally comprising timing circuit means connected to the integrated circuit means for limiting the time period during which a sequential coded signal may be compared with said predetermined sequential code pattern.

14. The electronic access control device of claim 13 additionally comprising debouncing circuit means incorporated in an input circuit of said device connected between a power source and the integrated circuit means to debounce the signals or damp out unwanted stray static voltages or currents provided by or through the switch means.

15. The electronic access control device of claim 14 including separate tamper means connected to said printed circuit board to detect when an attempt is made to separate said protective switch plate from said circuit board and activating an alarm upon detection.

16. The electronic access control device of claim 15 wherein the tamper means comprises a reed switch attached to said circuit board and a magnet attached to said switch plate adjacent to said reed switch, said tamper means being separately connected intermediate to a power supply and to an electrically actuated alarm to indicate when the circuit board is tampered to such an extent as to at least partially separate the reed switch and the magnet.

17. The electronic access control device of claim 16 additionally comprising a status indicating circuit including light emitting diodes connected to suitable electrical circuits in said access control means to indicate when said circuits are activated, said light emitting diodes being positioned so as to be visible through the toggle switch opening of said face plate.

18. The electronic access control device of claim 17 additionally comprising a toggle switch means connected between the power supply and the access control means of the invention to control the power to the components of said access control device other than the tamper circuit means.

19. The electronic access control device of claim 17 wherein there are at least two light emitting diodes one of which is connected across power leads to said control device and the other of which is connected across an output lead and an input lead of the output circuit of said access to control device.

20. The electronic access control device of claim 14 wherein the debouncing circuit means includes capacitors and resistors arranged and constructed to provide an RC time constant or delay for signals derived from the switch means.

* * * * *